US006616421B2

(12) United States Patent
Mruk et al.

(10) Patent No.: US 6,616,421 B2
(45) Date of Patent: Sep. 9, 2003

(54) DIRECT DRIVE COMPRESSOR ASSEMBLY

(75) Inventors: Gerald K. Mruk, West Seneca, NY (US); Peter J. Weber, Williamsville, NY (US); Edward S. Czechowski, Orchard Park, NY (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/738,059

(22) Filed: Dec. 15, 2000

(65) Prior Publication Data

US 2002/0076336 A1 Jun. 20, 2002

(51) Int. Cl.[7] ..... F04B 17/00; F04B 35/00

(52) U.S. Cl. ..... 417/350; 417/356; 417/423.7; 310/154.01

(58) Field of Search ..... 417/350, 423.5, 417/423.7, 356, 382, 392, 420; 310/154.01, 154.33; 318/722

(56) References Cited

U.S. PATENT DOCUMENTS

| | | | | | |
|---|---|---|---|---|---|
| 3,947,155 | A | | 3/1976 | Bidol | 417/417 |
| 4,179,630 | A | | 12/1979 | Stuber | 310/15 |
| 4,229,142 | A | * | 10/1980 | Le Dall et al. | 417/38 |
| 4,428,715 | A | | 1/1984 | Wiggins | 415/199.2 |
| 4,558,992 | A | * | 12/1985 | Hamano et al. | 417/250 |
| 4,758,132 | A | | 7/1988 | Hartwig | 417/353 |
| 4,977,344 | A | | 12/1990 | Obradovic | 310/217 |
| 5,112,202 | A | * | 5/1992 | Oshima et al. | 417/423.7 |
| 5,128,576 | A | | 7/1992 | Obradovic | 310/217 |
| 5,181,837 | A | * | 1/1993 | Niemiec | 417/350 |
| 5,356,272 | A | * | 10/1994 | Nagata et al. | 417/366 |
| 5,522,653 | A | | 6/1996 | Fulks et al. | 303/162 |
| 5,555,956 | A | * | 9/1996 | Voss et al. | 184/6.16 |
| 5,654,601 | A | | 8/1997 | Fulton | 310/168 |
| 5,704,761 | A | * | 1/1998 | Kobayashi et al. | 415/182.1 |
| 5,770,910 | A | | 6/1998 | Horst | 310/214 |
| 5,857,348 | A | * | 1/1999 | Conry | 62/209 |
| 5,899,673 | A | * | 5/1999 | Bosley et al. | 417/423.14 |
| 6,015,270 | A | | 1/2000 | Roth | 417/259 |
| 6,043,580 | A | * | 3/2000 | Vogel et al. | 310/179 |
| 6,056,518 | A | | 5/2000 | Allen et al. | 417/355 |
| 6,070,421 | A | * | 6/2000 | Petrovich et al. | 62/210 |
| 6,086,347 | A | * | 7/2000 | Ryska et al. | 418/212 |
| 6,111,333 | A | * | 8/2000 | Takahashi et al. | 310/90.5 |
| 6,193,473 | B1 | * | 2/2001 | Mruk et al. | 417/350 |
| 6,296,441 | B1 | * | 10/2001 | Gozdawa | 415/180 |
| 6,375,438 | B1 | * | 4/2002 | Seo | 417/366 |

OTHER PUBLICATIONS

Bonnett, Austin H. "Switched Reluctance Motors & Drives for Industrial Applications", U.S. Electrical Motors, p. 1–10, Jan. 9, 1995.

Langnau, Leslie C., "Are Switched–Reluctance Motors For You?" *Power Transmission, The Magazine of Motion Systems Design* 38:5:21–24; May 1996.

Tang, Yifan et al, "Reliability of Switched Reluctance Motor and Drive for Industrial Applications" p. 1–7, U.S. Electrical Motors.

* cited by examiner

*Primary Examiner*—Charles G. Freay
*Assistant Examiner*—Han L. Liu
(74) *Attorney, Agent, or Firm*—Michael P. Hartmann; Peter A. Bielinski

(57) ABSTRACT

A centrifugal compressor assembly, especially one having two or more stages, comprises a first compressor casing having. A fluid inlet and a fluid outlet and a first impeller rotatable within the first compressor casing. The assembly further comprises a second compressor casing having a fluid inlet and a fluid outlet and a second impeller rotatable within the second compressor casing. Drive for the compressors is provided by an electric motor, preferably a permanent magnet motor, disposed between the first and second compressor casings and comprising a stator and a rotor rotatable within the stator. A drive shaft is provided, wherein the first impeller, second impeller and the rotor are mounted on the drive shaft and rotatable therewith.

11 Claims, 1 Drawing Sheet

DIRECT DRIVE COMPRESSOR ASSEMBLY

TECHNICAL FIELD OF THE INVENTION

The present invention relates to a compressor assembly, in particular to a compressor assembly comprising a compressor having a rotatable impeller and a motor driving the compressor, the impeller and the motor being linked by a direct drive.

BACKGROUND OF THE INVENTION

Compressors having an impeller rotatable within a compressor casing are well known in the art. Such compressors include both centrifugal compressors or radial flow compressors and axial flow compressors. In centrifugal or radial flow compressors, the fluid being compressed is caused by the rotating impeller to flow along a passageway in which the cross sectional area normal to the flow gradually decreases in the direction of flow. Axial compressors operate by causing the fluid to be compressed to flow along a passage of constant or substantially constant cross sectional area. An example of such a compressor is disclosed in U.S. Pat. No. 4,428,715.

Compressors of the aforementioned types may be driven by a range of motors, such as internal combustion engines, and turbines. However, in many applications it is both preferable and desirable to drive centrifugal and axial flow compressors using electric motors. Typically, induction or synchronous electric motors have been employed to drive compressors. To date, a major drawback associated with the use of electric motors to drive rotating impeller compressors has been the linkage between the electric motor and the compressor impeller. A given compressor will have a specific speed of rotation of the impeller in order to achieve the compression duty required of it. At the same time, an induction electric motor will have an optimum speed of rotation, at which the torque output is at a maximum. Heretofore, in order to link the compressor with a suitable electric drive motor, it has been necessary to employ an arrangement of one or more gears. In this way the different optimum speeds of rotation of the compressor and the electric motor can be accommodated. A particular problem arises in the case of high speed centrifugal compressors, having power requirements of the order of 200 horsepower or less. Such compressors are often required to operate at high speeds, which can be in excess of 50,000 rpm. The optimum speed of rotation of an induction electric motor suitable for this duty is far lower than the speed of rotation required of the high speed compressor, requiring a gear assembly to be employed in the drive assembly of the compressor. However, for such compressors, the high costs of incorporating an arrangement of gears in the drive assembly results in a significant economical disadvantage. This in turn has led to other forms of compressors, such as screw compressors, being favored for such duties.

Accordingly, there is a need for a compressor assembly in which the requirement for a gear assembly in the drive is dispensed with and in which the compressor and the electric motor are directly linked. There is an especial need for a direct drive compressor and electric motor assembly capable of operating at the high speeds of rotation specified above.

A rotordynamic machine is disclosed in U.S. Pat. No. 6,043,580, for use in the pumping of a fluid. The machine comprises an electrical assembly in combination with a turbomachine or centrifugal pump. The electrical assembly acts as a combined electric motor and bearing assembly, having a rotor supported and rotated by magnetic fields generated in a stator. In this way, the motor is bearing-free. The rotor of the motor is formed as part of the shaft connecting the electrical assembly with the turbomachine or pump. U.S. Pat. No. 6,043,580 discloses that the combined electric motor and bearing assembly may be arranged on the principles of an induction motor, an asynchronous motor, a reluctance motor, or a synchronous motor. Specific designs mentioned in U.S. Pat. No. 6,043,580 include assemblies having a rotor with one or more permanent magnets and a rotor designed as a cage rotor with a short circuited cage. In the specific embodiment disclosed and described in detail in U.S. Pat. No. 6,043,580, the combined motor and bearing assembly comprises a stator having two sets of current windings, one set for generating the magnetic fields to rotate the rotor, the second set for generating the magnetic journaling for supporting the rotor shaft in position. The rotor is designed as a cage rotor, having the same number of poles as the stator windings generating the drive, but a different number of poles to the stator windings providing the support for the shaft.

U.S. Pat. No. 6,043,580 is concerned specifically with overcoming the problems associated with magnetic bearings and their limited bearing capacity. The solution proposed, as discussed above, is to arrange an electric motor, which may be one of a wide variety of arrangements of electric motor, such that the rotor is both supported and rotated by a magnetic field. U.S. Pat. No. 6,043,580 does not disclose or suggest an assembly for use at the high speeds of rotation specified above.

U.S. Pat. No. 6,056,518 discloses a fluid pump for use in the coolant system for an automobile. The fluid pump disclosed comprises a switched reluctance electric motor, in which the impellor of the pump is the rotor of the electric motor. The operating speeds for the fluid pump disclosed in U.S. Pat. No. 6,056,518 are low, being stated to be from 0 to 5000 rpm. U.S. Pat. No. 6,056,518 specifically teaches that the advantage of using the switched reluctance motor is that it does not rely for operation upon the use of magnets, which are stated to be heavy, costly and to degrade quickly over time.

SUMMARY OF THE INVENTION

According to the present invention there is provided a compressor assembly comprising

- a compressor having a compressor casing comprising a fluid inlet and a fluid outlet;
- an impeller rotatable within the compressor casing;
- an electric motor;
- a rotatable drive shaft assembly extending from the electric motor into the compressor casing;
- the impeller being mounted on the drive shaft assembly and rotatable therewith within the compressor casing; and
- the electric motor comprising a stator and a rotor, the rotor being mounted on the drive shaft assembly and rotatable therewith; wherein the compressor assembly operates at a speed of 25,000 rpm or higher.

A range of electric motors may be employed in the compressor assembly of the present invention. Such motors include induction motors, synchronous motors and asynchronous motors.

Surprisingly, contrary to the suggestions in the prior art, it has been found that the use of a permanent magnet electric motor allows a direct drive compressor assembly to be constructed which is particularly suitable for operation at high speeds. Accordingly, a permanent magnet motor is the preferred motor for use in the assembly of the present invention.

It has been found that a permanent magnet motor may be employed to drive a rotating impeller compressor using a direct drive configuration, that is one in which the impeller of the compressor and the rotor of the motor are directly connected and rotate at the same speed. It has been found that a permanent magnet motor may be used to drive the rotatable impeller of a compressor, allowing the gear assembly or gear box to be dispensed with and a direct drive assembly to be employed.

The compressor assembly of the present invention is operated at high speeds. In this respect, high speed operation is considered to be when the compressor and motor operate at speeds of 25,000 rpm and higher. The compressor assembly of the present invention may be operated at speeds of 50,000 rpm, with speeds of 75,000 rpm and higher being possible. With such high speeds of operation, it has been found that the efficiency of the motor design plays an important role. Induction motors, require a magnetic field to be induced in the rotor, which is typically comprised of a plurality of iron laminations. At the high speeds of rotation required of the compressor assembly of the present invention, the need to induce a magnetic field in the rotor leads to a marked inefficiency in the power usage of the motor, in turn leading to an efficient operation of the compressor. It has been found that a permanent magnet motor overcomes these problems of low efficiency encountered with induction motors. Accordingly, while induction motors may be employed in the compressor assembly of the present invention, it is preferred to employ a more efficient motor arrangement, such as a permanent magnet motor, when operating at speeds in the upper regions of the ranges mentioned above.

Further, permanent magnet electric motors are quieter in operation than other forms of motor, in particular switched reluctance motors, and allow a compact motor and compressor assembly to be constructed.

The compressor used in the assembly of the present invention may be either an axial flow compressor, or a centrifugal or radial flow compressor. The preferred embodiment of the present invention employs a centrifugal or radial flow compressor.

Although any size or rating of compressor may be used, the compressor assembly of the present invention offers particular advantages when the compressor has a power input requirement of less than 200 horse power. It has been found that the compressor assembly of the present invention offers significant advantages when the compressor has a power input requirement of from 75 to 200 horse power. The permanent magnet motor is of particular advantage when the power requirement is from 100 to 200 horse power, especially from 100 to 150 horse power.

In its simplest form, the compressor assembly of the present invention comprises an electric motor having a rotor mounted on a shaft, the shaft in turn being connected directly to the impellor of the compressor. Such a compressor assembly thus consists essentially of an electric motor and a single compressor unit.

The compressor assembly preferably comprises first and second compressors having first and second compressor casings, each of the first and second compressor casings comprising a fluid inlet and a fluid outlet. First and second impellers are located within and rotatable within the first and second compressor casings respectively. The first and second impellers are mounted on the drive shaft assembly and are rotatable therewith. Such a compressor assembly may comprise two separate compressors driven from the same permanent magnet motor. More preferably, however, the two compressors are combined to form a two-stage compressor assembly. In such an arrangement, the fluid outlet of the first compressor casing communicates with the fluid inlet of the second compressor casing. In a two compressor assembly or two-stage compressor assembly, the electric motor is most conveniently disposed between the first and second compressor casings, with the rotor of the electric motor being mounted on the drive shaft assembly between the first and second impellers.

References in this specification to a "drive shaft assembly" are to a linkage transferring drive from the electric motor to the impellers of the compressor assembly. The drive shaft assembly provides a direct drive between the rotor of the electric motor and the impellers. Such a drive is characterized by the motor and the impeller rotating at the same speed. The drive shaft assembly may comprise one or more individual shafts linked by couplings so as to allow the drive to be transferred. A most convenient and advantageous assembly is one in which the rotor of the electric motor and the impeller are mounted on a single shaft.

A preferred embodiment of the present invention is a two stage centrifugal compressor assembly comprising:

- a first compressor casing having a fluid inlet and a fluid outlet;
- a first impeller rotatable within the first compressor casing;
- a second compressor casing having a fluid inlet and a fluid outlet;
- a second impeller rotatable within the second compressor casing; and
- a permanent magnet motor disposed between the first and second compressor casings and comprising a stator and a rotor rotatable within the stator;
- a drive shaft; wherein
  - the first impeller, second impeller and the rotor are mounted on the drive shaft and rotatable therewith; and
  - the fluid outlet of the first compressor casing communicates with the fluid inlet of the second compressor casing;
- wherein the compressor assembly operates at a speed of 25,000 rpm or higher.

BRIEF DESCRIPTION OF THE DRAWINGS

Embodiments of the present invention will now be described by way of example only having reference to the accompanying drawing, in which:

The FIGURE is a diagrammatic illustration of a two-stage compressor assembly of a preferred embodiment of the present invention.

Figure 1:
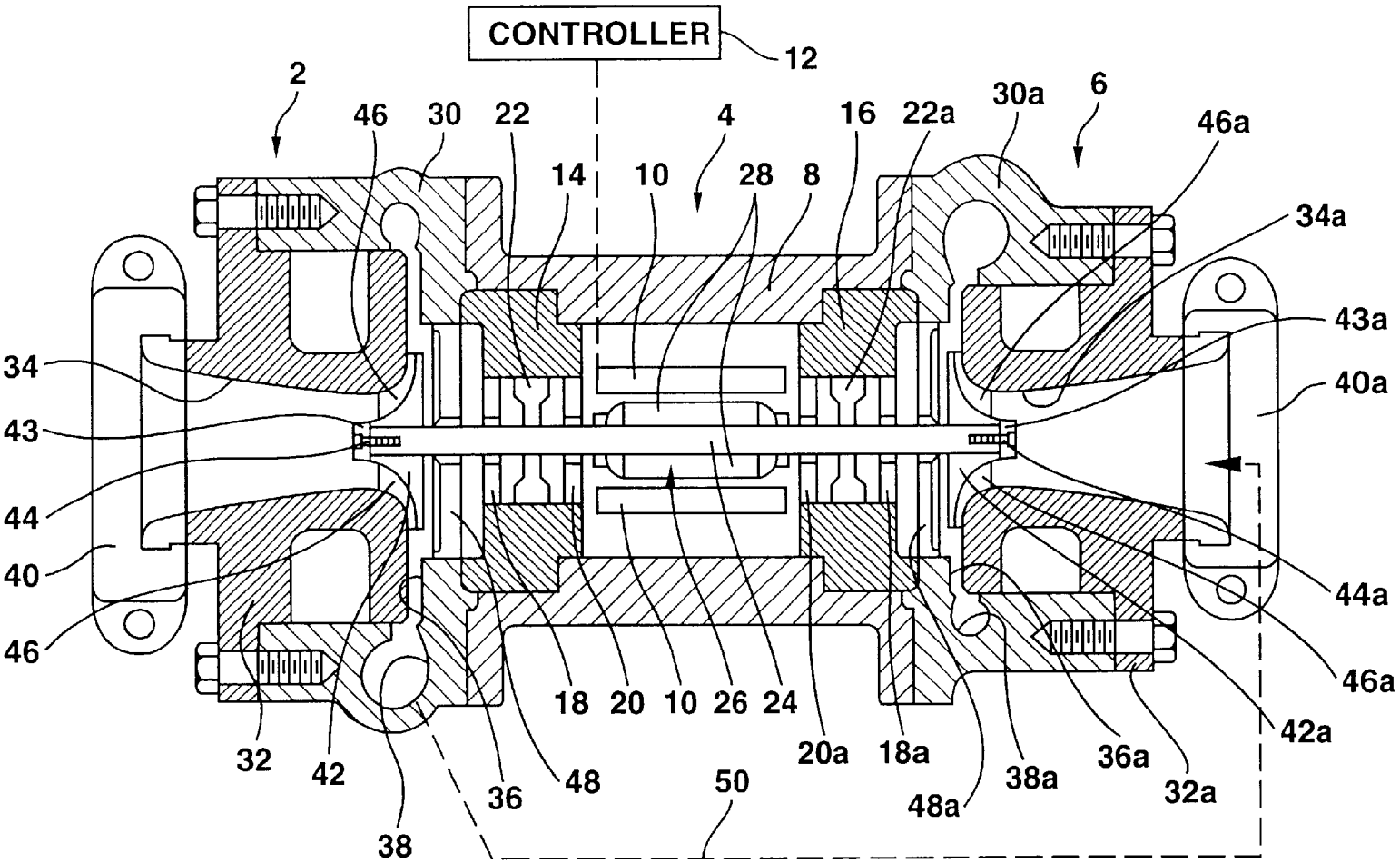

It is noted, however, that the appended drawing illustrates only a typical embodiment of the present invention and is therefore not to be considered a limitation of the scope of the invention, which includes other equally effective embodiments.

DESCRIPTION OF THE PREFERRED EMBODIMENTS OF THE INVENTION

Referring to the FIGURE, a two-stage centrifugal compressor assembly is shown having a first centrifugal compressor stage generally represented as 2, a permanent magnet motor assembly generally represented as 4, and a second centrifugal compressor stage generally represented as 6.

Permanent magnet electric motors for use in the present invention are known in the art. In general, a permanent magnet motor comprises a rotor having one or more permanent magnets. The permanent magnet may be formed as a single or multiple blocks of solid magnetic material retained in the rotor. The permanent magnets may be mounted on the surface of the rotor, in which case the motor is referred to as a "surface mount" permanent magnet motor. Alternatively, the permanent magnets may be imbedded within the material of the rotor. If the material of the rotor is iron, the motor is referred to as an "interior" permanent magnet motor. Interior permanent magnet motors have a lower resistance to the flow of magnetic flux within the stator between the poles of the permanent magnets. This allows interior permanent magnets to be used over a wider range of speeds of operation.

In general, the stator of the permanent magnet motor comprises a plurality of coils. In use, the coils are successively energized by means of a controller supplying electrical current to the coils to form a rotating magnetic field. This rotating magnetic field induces rotation of the rotor as a result of the interaction of the magnetic field induced in the stator coils and the magnetic field present around the rotor as a result of the permanent magnets.

Referring to the FIGURE, the permanent magnet motor assembly 4 comprises a generally cylindrical motor casing 8. The motor casing may incorporate water cooling or other cooling means (not illustrated). Mounted to the casing is a plurality of wound coils making up the stator. Two coils are schematically represented as 10 in the FIGURE. From the foregoing discussion, it will be understood that the stator may comprise more than the coils represented in the FIGURE. The poles 10 of the stator are connected to a controller, represented by box 12 in the FIGURE, and to an electrical power source (not shown). Controllers for the permanent magnet motor are known in the art. The controller 12 acts to open and close the electrical connection between the coils 10 and the power source, to thereby generate the rotating magnetic field required to induce rotation of the rotor. The controller may utilize a rotor position transducer (not shown) to determine the open and close timing of the electrical connections between the coils 10 and the power source. The rotor position transducer may comprise any suitable sensor, for example an optical or magnetic sensor. In the alternative, sensorless controllers may be employed.

The permanent magnet motor assembly further comprises first and second casing ends 14 and 16, mounted in the end portions of the generally cylindrical motor casing 8. Each casing end 14, 16 has a central bore extending co-axially with the central longitudinal axis of the motor casing 8. The first casing end 14 houses an outer seal 18 and an inner seal 20 at each end portion of the central bore. In addition, the first end casing 14 supports a bearing 22, mounted centrally within the central bore approximately equidistant from the outer and inner seals 18 and 20. Any suitable bearing may be employed that is capable of operating under the conditions of high speed of rotation required of the permanent magnet motor in the compressor assembly of the present invention. A preferred bearing configuration is a combined hydrodynamic/hydrostatic bearing as described in U.S. Pat. Nos. 4,365,849 and 5,872,875, the contents of both documents being incorporated herein by reference. Alternative bearing configurations include magnetic bearings, which offer the advantage of reduced wear and friction, and thus improved efficiency, at the high speeds of operation of the compressor assembly of the present invention. The second casing end 16 comprises a similar bore and supports outer and inner seals 18*a* and 20*a*, together with a bearing 22*a*, in a similar configuration to that in the first casing end 14.

A shaft 24 extends longitudinally through the motor casing 8 and is supported by the bearings 22 and 22*a* in the bores in the first and second casing ends 14 and 16. Thrust bearings may be provided in the casing ends 14 and 16 to accommodate thrust loads on the shaft. Suitable thrust bearings are of conventional design and well known in the art.

The shaft 24 has its longitudinal axis coincident with the longitudinal axis of the motor casing 8. A rotor 26 is mounted around the central portion of the shaft 24 and is positioned between the coils 10 of the permanent magnet motor. In this position, the rotor 26 is free to rotate within the magnetic fields generated by the coils 10 of the stator. The rotor 26 as shown in the FIGURE comprises a pair of permanent magnets 28. Other embodiments of the invention comprise rotors having a greater number of magnets. Under the action of the controller 12, power is supplied to the poles 10 of the stator in such a way that the magnets 28, and hence the rotor 26 and its attached shaft 24, are caused to move under the influence of a varying magnetic field.

The first compressor stage 2 is mounted on the end of the motor casing 8 adjacent the first casing end 14. The first compressor stage 2 comprises an outer compressor casing 30 and an inner compressor casing 32, both generally cylindrical in form and mounted with their central longitudinal axes coincident with that of the permanent magnet motor casing 8. The inner compressor casing 32 extends inwards from the outer free end of the outer compressor casing 30 and has a tapered central bore 34 narrowing in the direction of the permanent magnet motor assembly 4. The open end of the tapered central bore 34 in the free end of the compressor assembly 2 forms a fluid inlet for the first stage compressor. The inner and outer compressor casings 30 and 32 define between their inner surfaces an annular chamber 36 extending radially outwards from the inner end of the tapered central bore 34. The tapered bore 34 and the annular chamber 36 together form a compression chamber. An annular cavity 38 extends around and communicates with the annular chamber 36. The annular cavity 38 forms a fluid outlet for the first stage compressor. An inlet duct 40 is mounted on the outer end of the inner compressor casing 32 to provide a connection for the fluid inlet of the first stage compressor.

The shaft 24 extends beyond the first casing end 14 and into the compression chamber formed by the tapered bore 34 and the annular chamber 36. An impeller 42 is located in the compression chamber and is mounted on the end portion of the shaft 24 by means of an interference fit or other suitable means. A balance washer 43 is mounted on the end of the shaft 24 by a bolt 44. The impeller 42 has a plurality of vanes 46 having a curved tapered form such that a fluid flow chamber of reducing cross-sectional area normal to the flow is defined between the vanes 46 and the inner wall of the inner compressor casing 32 when traveling from the tip of the impeller to the base.

A compressor seal 48 is located in the inner orifice of the outer compressor casing 30 adjacent the first motor casing end and extends around the shaft 24.

In operation, fluid to be compressed, such as air or nitrogen gas, is drawn into the first stage compressor assembly 2 through the inlet duct 40, has velocity imparted mechanically by the vanes 46 of the impeller 42, and is caused to flow through the compression chamber. The compressed fluid leaves the first stage compressor through the annular cavity 38 in the outer casing 30.

A second stage compressor assembly 6 is mounted on the end of the motor casing 4 opposing the first stage compressor assembly 2. The second stage compressor assembly is comprised of components of similar form and function to those of the first stage compressor, indicated in the FIGURE by the same reference numerals as the corresponding components of the first stage compressor, but with the suffix "a".

The compressor assembly of the present invention may comprise a single compressor, or may comprise multiple compressors. Embodiments comprising multiple compressors may have the individual compressors linked so as to form multiple compressor stages. In the embodiment shown in the FIGURE, the two compressor assemblies 2 and 4 are linked to form a two-stage compressor. To effect this, the fluid outlet of the first compressor assembly 2, represented by the annular cavity 38, is connected to the inlet of the second compressor assembly 6 via the inlet duct 40*a*, as indicated by the connection 50

The compressor assembly of the present invention provides a number of significant advantages over known compressor systems. In particular, the overall assembly, by dispensing with the need for a complicated coupling between the compressor and the motor, reduces the overall number of components. This in turn reduces unit costs and, most importantly, increases reliability. The compressor assembly of the present invention is particularly suited to high speed compressor systems, in particular those operating at speeds in excess of 25,000 rpm, more especially in excess of 50,000 rpm. Speeds of operation in excess of 75,000 rpm can be achieved with the compressor assembly of the present invention. In addition, the realization of the present invention makes available low powered compressor assemblies, that is ones in which the compressor has an input power of less than 200 horse power, that are both economical and reliable. The compressor assembly shown in the FIGURE is typically one having a power requirement for driving the compressor of about 150 horse power. The permanent magnet motor has been found to be of particular advantage when delivering power at this order to magnitude to the compressor assembly. It will be understood that alternative arrangements of a permanent magnet motor and a compressor may also be employed having a different power requirement.

While the particular embodiment of the assembly of the present invention as herein disclosed in detail is fully capable of obtaining the objects and advantages herein stated, it is to be understood that it is merely illustrative of the presently preferred embodiments of the invention and that no limitations are intended by the details of construction or design herein shown other than as described in the appended claims.

What is claimed is:

1. A compressor assembly, for compressing a fluid, which fluid consists essentially of a gas, said compressor assembly comprising:

a compressor having a compressor casing comprising a fluid inlet and a fluid outlet;

an impeller rotatable within the compressor casing;

a permanent magnet electric motor;

a rotatable drive shaft assembly extending from the electric motor into the compressor casing;

the impeller being mounted on the drive shaft assembly and rotatable therewith within the compressor casing; and the electric motor comprising a stator and a rotor, the rotor being mounted on the drive shaft assembly and rotatable therewith;

in operation, the permanent magnet electric motor and the impeller rotating at a speed of 25,000 rpm and higher.

2. A compressor assembly as claimed in claim 1, wherein the compressor is a centrifugal compressor.

3. A compressor assembly as claimed in claim 1, wherein the compressor rotates at a speed greater than 50,000 rpm.

4. A compressor assembly as claimed in claim 1, wherein the compressor has an input power of less than 200 horse power.

5. A compressor assembly as claimed in claim 4, wherein the compressor has an input power of from 75 to 150 horse power.

6. A compressor assembly as claimed in claim 1 comprising first and second compressors having first and second compressor casings;

each of the first and second compressor casings comprising a fluid inlet and a fluid outlet;

first and second impellers rotatable within the first and second compressor casings respectively;

the first and second impellers being mounted on the drive shaft assembly and rotatable therewith.

7. A compressor assembly as claimed in claim 6, wherein the fluid outlet of the first compressor casing communicates with the fluid inlet of the second compressor casing.

8. A compressor assembly as claimed in claim 6, wherein the electric motor is disposed between the first and second compressor casings, with the rotor of the electric motor being mounted on the drive shaft assembly between the first and second impellers.

9. A compressor assembly as claimed in claim 1, wherein the drive shaft assembly comprises a single drive shaft.

10. A compressor assembly as claimed in claim 1, said gas being selected from the group consisting of air and nitrogen.

11. A two stage centrifugal compressor assembly comprising:

a first compressor casing having a fluid inlet and a fluid outlet, which fluid consists essentially of a gas;

a first impeller rotatable within the first compressor casing;

a second compressor casing having a fluid inlet and a fluid outlet;

a second impeller rotatable within the second compressor casing; and a permanent magnet motor disposed between the first and second compressor casings and comprising a stator and a rotor rotatable within the stator;

a drive shaft; wherein the first impeller, second impeller and the rotor are mounted on the drive shaft and rotatable therewith; and the fluid outlet of the first compressor casing communicates with the fluid inlet of the second compressor casing;

in operation, the permanent magnet motor and the first and second impellors rotating at a speed of 25,000 rpm or higher.

* * * * *